United States Patent [19]

Mayer et al.

[11] 4,377,442

[45] Mar. 22, 1983

[54] SYSTEM FOR COUPLING A QUENCHING CAR TO A HOOD CAR AND FOR BRAKING THE HOOD CAR

[75] Inventors: Georg Mayer, Ratingen; Franz Theilenberg, Essen, both of Fed. Rep. of Germany

[73] Assignee: Hartung, Kuhn & Co. Maschinenfabrik, Fed. Rep. of Germany

[21] Appl. No.: 264,238

[22] Filed: May 18, 1981

[30] Foreign Application Priority Data

Jun. 4, 1980 [DE] Fed. Rep. of Germany ..... 3021192

[51] Int. Cl.[3] ..... C10B 34/14; C10B 41/00; C10B 45/00

[52] U.S. Cl. ..... 202/263; 202/270

[58] Field of Search ..... 202/239, 262, 263, 270; 213/81, 116, 177, 200

[56] References Cited

U.S. PATENT DOCUMENTS

| | | | |
|---|---|---|---|
| 425,445 | 4/1890 | Miller | 213/81 |
| 3,647,636 | 3/1972 | Helm | 202/263 |
| 3,981,778 | 9/1976 | Schulte et al. | 202/263 |
| 4,050,588 | 9/1977 | Miller | 213/81 |
| 4,196,053 | 4/1980 | Grohmann | 202/263 |
| 4,312,713 | 1/1982 | Mayer et al. | 202/262 |

*Primary Examiner*—Bradley Garris

*Attorney, Agent, or Firm*—Dressler, Goldsmith, Shore, Sutker & Milnamow, Ltd.

[57] ABSTRACT

A coke oven hood car is provided with a coupling opening defined on two sides by a pair of spring biased stop bars which can be engaged by a quenching car driver element which is extendable and retractable into and out of, respectively, the coupling opening by a hydraulic driver element cylinder-piston actuator. A hydraulic brake control cylinder-piston actuator is provided with a piston rod adapted to be actuated by the driver element of the quenching car when the driver element is extended into the hood car coupling opening. A hydraulically operated brake system is provided for braking the hood car when the quenching car driver element engages the hydraulic brake control cylinder-piston actuator piston rod. An emergency brake control is provided and consists of a switching control means on the quenching car connected to the driver element cylinder-piston actuator and a switching cam mounted at a selected position along the path of travel of the quenching car for actuating the switching control means to operate the driver element cylinder-piston actuator for retracting the driver element out of the hood car coupling opening and permitting application of the brake system.

3 Claims, 2 Drawing Figures

SYSTEM FOR COUPLING A QUENCHING CAR TO A HOOD CAR AND FOR BRAKING THE HOOD CAR

TECHNICAL FIELD

This invention relates to equipment for operating a battery of coke oven machines and is more particularly related to mechanisms for coupling a hood car to a quenching car and for braking the hood car.

BACKGROUND OF THE INVENTION

Mechanisms for coupling a quenching car to a hood car and for braking the hood car are known. One such mechanism is described in U.S. Pat. No. 3,981,778. As disclosed in that patent, the quenching car and the hood car are mounted for movement parallel to the battery of coke ovens with the hood car riding on a pair of rails and with the quench car riding below the hood car on another pair of rails.

It would be desirable to provide an improved mechanism for coupling the quenching car to the hood car and it would be desirable for such an improved coupling mechanism to interact with a braking system for braking the hood car whenever the hood car is uncoupled from the quenching car and for releasing the braking of the hood car whenever the hood car is coupled to the quenching car.

Further, it would be desirable to provide such a coupling mechanism that would accommodate coupling of the quenching car to the hood car even though the quenching car and the hood car may not be precisely aligned.

In addition, it would be desirable for such a coupling apparatus to reduce the shock loading reaction forces on the quenching car and hood car resulting from the starting and stopping movements of the cars.

SUMMARY OF THE INVENTION

The present invention includes a quench car movable in forward and backward directions of travel parallel to a coke oven battery and a track mounted hood car also movable in forward and backward directions of travel parallel the coke oven battery. The hood car has a hood for trapping and carrying the dirty gases rising from the glowing coke on the quenching car.

Coupling means is provided between the hood car and the quenching car that is operable when the quenching car is moving in the forward and backward directions for coupling together the hood car and the quenching car and for permitting movement of the hood car and the quenching car together in the forward and backward directions.

The coupling means includes a coupling opening defined in the hood car. The coupling means also includes a driver element on the quenching car and a driver element cylinder-piston actuator, operable through a hydraulic coupling control system by a pressurized medium, for moving the driver element transversely of the forward and backward directions of travel of the quenching car and hood car into and out of the coupling opening in the hood car whereby the driver element may be engaged with, or disengaged from, the hood car.

The coupling means further includes a pair of spaced-apart parallel stop bars defining at least a part of the coupling opening. Preferably, the stop bars are oriented transversely of the directions of forward and backward travel of the hood car and quenching car. The stop bars are adapted to be horizontally displaced toward and away from each other in substantially parallel relationship. Also, compression coupling springs normally bias or urge the stop bars towards each other. The stop bars also have mutually facing sides which at least partially define downwardly diverging surfaces to accommodate entry of the driver element between the stop bars from below.

Brake means are provided on the hood car for automatically stopping the hood car movement when the hood car is uncoupled from the quenching car and for being released to permit movement of the hood car when the quenching car is coupled to the hood car.

The brake means includes a stationary brake rail, a pair of pivotally mounted brake jaws adapted to grip the brake rail, brake compression springs urging the brake jaws to pivot towards each other and against the brake rail, a hydraulic brake release cylinder-piston actuator, and a hydraulic brake control cylinder-piston actuator. The hydraulic brake control cylinder-piston actuator includes an associated control piston rod adapted to be actuated by the driver element of the quenching car. The hydraulic control cylinder-piston actuator is connected via a hydraulic brake control system to operate the hydraulic brake release cylinder-piston actuator.

The cylinder of the hydraulic brake release cylinder-piston actuator is connected to one of the brake jaws and the actuator has an associated piston rod connected to the other of the brake jaws such that when the actuator is operated, the brake jaws are pivoted away from each other against the action of the compression brake springs and away from the stationary brake rail.

An emergency brake control system is provided and consists of a switching control means on the quenching car connected via the pressure medium in the hydraulic coupling control system to the driver element cylinder-piston actuator. The switching control means is activated by a stationary switching cam mounted at a selected position along the path of travel of the quenching car to effect operation the driver element cylinder-piston to retract the driver element out of the hood car coupling opening.

Numerous other advantages and features of the present invention will become readily apparent from the following detailed description of the invention and of one embodiment thereof, from the claims, and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
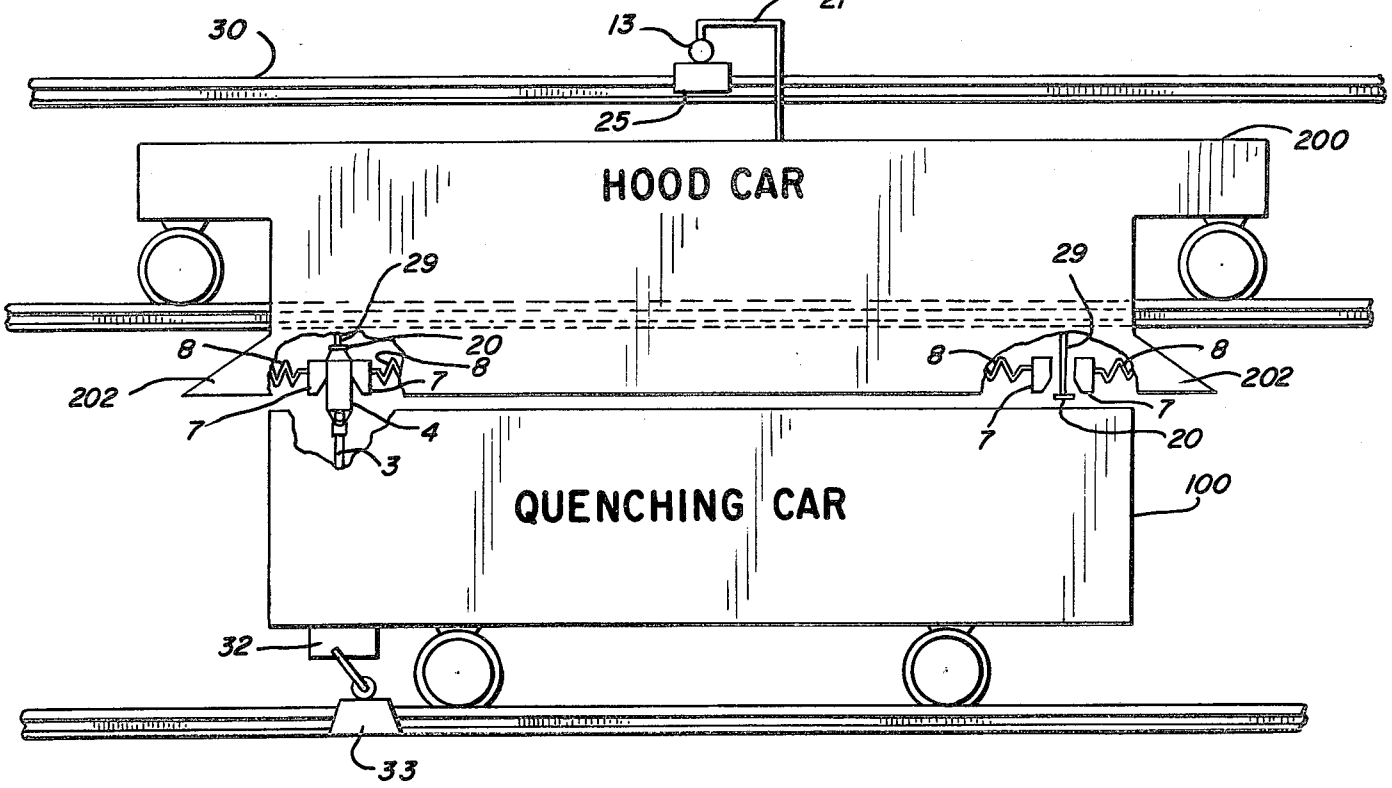
FIG. 1 is a schematic representation of the equipment according to the present invention with portions of the equipment shown broken away to illustrate interior locations of some of the mechanisms.

As best illustrated in FIG. 1, a quenching car 100 is provided for carrying glowing coke along a track and is movable in forward and backward directions of travel (x and y) parallel to the coke oven battery. A servicing machine or hood car 200 is mounted on a track above or alongside the quench car 100 for movement in the forward and backward directions of travel along the coke oven battery. The hood car 200 includes a conventional hood 202 for trapping and carrying the dirty gasses rising from the coke on the quenching car 100.

Typically, a traction car (not illustrated) is provided to move along the track in front of, or behind, the quenching car to pull or push the quenching car 100 along the track. The quenching car 100 is adapted to be connected to the hood car 200, by means described hereinafter in detail, so that the hood car 200 can move with the quenching car 100 when the quenching car is filled with coke.

The quenching car 100 is provided with a number of components for effecting the coupling of the quenching car 100 to the hood car 200. Briefly, the major components include the following: a vertically reciprocative driver element 3 on which a driver lug 4 is pivotally mounted about an axis or pin 5; a driver element hydraulic or pneumatic cylinder-piston actuator 2 having a piston rod that functions as the aforesaid driver element 3; and a hydraulic or pneumatic control system 1 which can be activated to operate the driver element cylinder-piston actuator 2 with a pressurized medium (e.g., a suitable hydraulic or pneumatic fluid).

Figure 2:
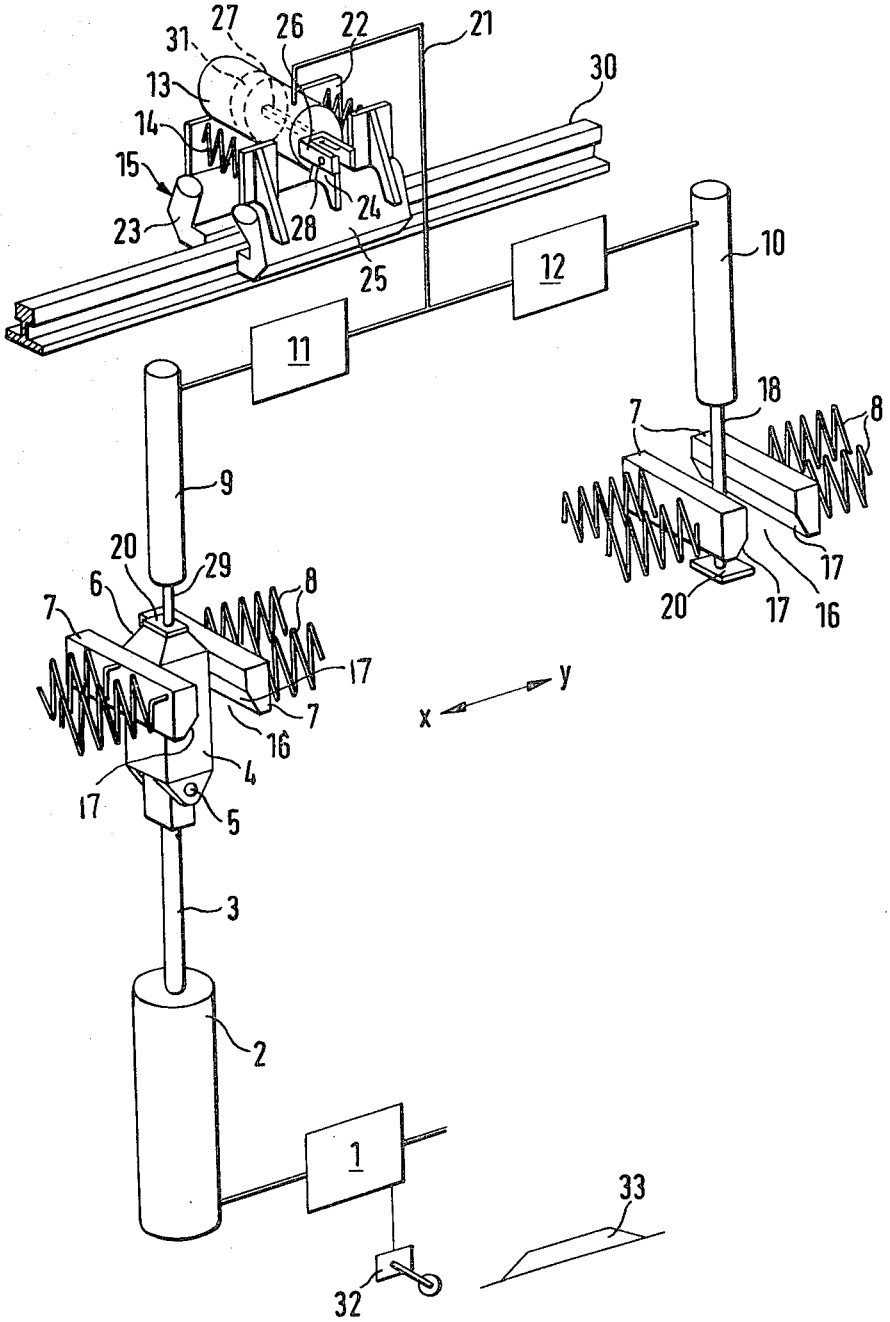
FIG. 2 is a schematic representation of the principal mechanisms of the present invention shown greatly enlarged.

As best illustrated in FIG. 2, the pivot axis 5 of the driver lug 4 is oriented substantially perpendicular to the directions x and y of travel of the quenching car 100 and hood car 200. Further, the driver lug 4 includes an end or end walls 6 wherein the end walls slant toward each other to define a blunt tapering end in the form of a pyramidal frustrum.

The hood car 200 also includes components for cooperating with the quenching car 100 to effect the coupling of the hood car 200 to the quenching car 100. The hood car 200 further includes components for terminating or braking the movement of the hood car 200 whenever the hood car 200 is uncoupled from the quenching car 100.

Briefly, the principal components of the systems in the hood car 200 include the following: a pair of spaced-apart, parallel stop bars 7 at each end of the hood car 200 with compression springs 8 biasing the stop bars 7 towards each other; two hydraulic or pneumatic brake control cylinder-piston actuators 9 and 10; two hydraulic or pneumatic brake control systems 11 and 12; and a brake mechanism comprising a hydraulic or pneumatic brake cylinder 13 operable on brake jaws 23 and 25 which are normally biased closed against a stationary brake rail 30 by brake compression springs 14.

The stop bars 7 define at least part of a coupling 16 opening at each end of the hood car 200. As illustrated, the stop bars 7 are oriented generally transversely of the directions x and y of forward and backward travel of the hood car 200 and quenching car 100. The stop bars 7 are adapted to be horizontally displaced toward and away from each other in parallel relationship. To this end, two compression springs 8 are provided for biasing each stop bar 7 inwardly towards the other opposed stop bar 7.

When the quenching driver lug 4 is moved upwardly into the coupling opening 16, the slanted surfaces or end 6 of the driver lug 4 urge the stop bars 7 further apart to accommodate entry of the driver lug 4 and thus effect an engagement of the quenching car 100 with the hood car 200.

The capability of the driver lug 4 to pivot about the transverse axis or pin 5 is a desirable feature in conjunction with the frustropyramidal tapered end 6 of the driver lug 4 since these structures accommodate misalignment or displacement of the coupling opening 16 relative to the driver lug 4. Further, the capability of the coupling structure to accommodate misalignment is further increased by the provision of at least partially diverging or beveled surfaces 17 on the mutually facing sides of the stop bars 7. Preferably, the angle defined by the beveled surfaces 17 of a pair of stop bars 7 is equal to, or greater than, the angle defined by the corresponding walls 6 at the frustropyramidal end of the driver lug 4.

The brake control cylinder-piston actuator 10 has a piston rod 18 which is normally maintained in the inactive position extending downwardly through the coupling opening 16. A pressure plate 20 is provided on the distal end of the piston rod 18. The plate 20 has a size substantially corresponding to the horizontal end face of the driver lug 4 and is adapted to be engaged by the end face of the driver lug 4.

The pressure plate 20 presents a relatively large bearing area for being engaged by the driver lug 4. This has the effect of increasing the capability of the mechanism to accommodate misalignment of the driver lug 4 relative to the coupling opening 16. Such misalignment may occur because of relative movement between the hood car 200 and the quenching car 100.

The hydraulic or pneumatic brake control cylinder-piston actuator 9 is substantially identical to the actuator 10 described above and has a piston rod 29 to which is secured an identical pressure plate 20 for engaging the driver lug 4. The two brake control cylinder-piston actuators 9 and 10 are appropriately arranged at opposite ends of the hood car 200 so that different operating conditions may be taken into account.

As can be seen, the two control cylinders 9 and 10 are connected, each via a pressure medium control 11 and 12, respectively, and a common pressure medium duct or conduit 21 to the brake release cylinder-piston actuator 13.

The cylinder portion of the brake release cylinder-piston actuator 13 is suitably disposed (by means not illustrated) on the hood car 200. A lever plate 22 is connected to one end of the cylinder part of the brake release cylinder-piston actuator 13. The lever plate 22 is also mounted for pivoting movement and is connected to the top of a brake jaw 23. Thus, the brake jaw 23 is adapted to be swung by means of the lever plate 22 toward or away from a brake rail 30 which runs parallel to the x and y travel directions of the hood car 200.

The actuator 13 includes an internal piston 31 connected to a piston rod 27. The piston rod 27 extends from the other end of the brake release cylinder-piston actuator 13 and carries a fork-shaped member 26. A stop or lug 24 is pivotally mounted about a pivot shaft 28 to the bracket 26 and is secured to the top portion of the other brake jaw 25.

As can be seen, the brake compression springs 14 are arranged to bias the top portions of the brake jaws 23 and 25 outwardly and to thereby swing the brake jaws 23 and 25 so that the lower gripping portions of the brake jaws 23 and 25 are moved inwardly against the brake rail 30 to provide a locking or braking engagement of the brake rail 30.

In operation, when the piston rod 29 is pushed upwardly into the hydraulic brake control cylinder-piston actuator 9 (or 10) by the driver lug 4, the hydraulic brake control system 11 (or 12), through the pressurized medium in the system, operates the hydraulic brake release cylinder-piston actuator 13 so that the brake jaws 23 and 25 are pivoted away from each other against the action of the brake compression springs 14 and away from the stationary brake rail 30. The hood car 200 is then free to be moved in the x or y travel directions by the quenching car 100 when the quenching car is coupled to the hood car 200.

If the driver lug 4 of the piston rod 3 of the actuating cylinder 2 is pulled back downward out of the coupling opening 16, the compression springs 14 press the brake jaws 23, 25 against the brake rail 30 again, the pressure medium being conducted back from the cylinder space by the piston 31 in the brake cylinder 13, into the hydraulic system via the ducts 21.

It is thus evident that the brake of the hood car in the unactuated state (i.e., in the state in which no energy is supplied) is always on. Application of the brake and provision of the requisite braking force are effected by the springs 14, preferably constructed as stacks of compression springs.

If the servicing machine consists of the hood car 200 and the traction car (not illustrated) of the quenching car 100, the quenching car travels into the position required for coupling. This is effected either by means of sight marks or by means of proximity switches (not illustrated), which can be constructed as magnetic switches. The novel structure for mounting the stop bars 7 for movement in either the x or y directions of travel against the springs 8 permits very coarse and rapid positioning. If by means of the actuating cylinder 2 of the driver apparatus the driver lug 4 is moved upwards, the taken-up coupling (stop bars 7) is placed in the required exact position. Furthermore, the coupling permits a very gentle start and prevents excessive stress loads on the hood car.

So that the traction or quenching car, because of the inattention of its operator, does not pull the hood car over its travel path and hence possibly cause severe damage to the quenching tower, a novel emergency brake control or safety device is built into the hydraulic coupling control system 1 of the driver apparatus.

A stationary switch cam 33 may be mounted at a selected position along the directions of travel of the quenching car 100, preferably adjacent or on the quenching car track. The quenching car 100 is also provided with a suitable switch and switching control means 32 that can be positioned to be actuated by the stationary switch cam 33. Typically, the switch cam 33 is located at a position some distance away from the end of the quenching and hood car tracks so that it will actuate the switch 32 before the quenching car 100 and hood car 200 can move all the way to the quenching tower (not illustrated) at the end of the tracks.

The switch and switching control means 32 is connected via a suitable conduit, containing the pressurized medium, to the hydraulic coupling control system 1 to operate the driver element cylinder-piston actuator 2 so as to retract the driver element cylinder-piston actuator piston 3 so that the driver lug 4 travels downwardly and out of the hood car coupling opening 16.

When the driver lug 4 moves out of the hood car coupling opening 16, the upward force on the pressure plate 20 of the brake control cylinder-piston actuator 9 (or 10) is necessarily removed. Thus, the compression springs 14 can close the brake jaws 23 and 25, which closure necessarily forces the pressurized medium out of the brake release cylinder-piston actuator 13 and into the hydraulic brake control cylinder-piston actuator 9 (or 10).

For reasons specific to the plant, it can be necessary to provide the hood car with two couplings. The system described above is technically designed such that it can be operated, with only minor changes in the pressure medium system, with one, two or arbitrarily many couplings. Instead of one brake cylinder, several can also be connected in parallel and act on a pair of, or several, brake jaws.

What is claimed is:

1. Equipment for operating a battery of coke oven machines, in combination said equipment comprising:

a quenching car movable in forward and backward directions of travel parallel to the coke oven battery;

a track mounted hood car movable in forward and backward directions of travel parallel to said coke oven battery and having a hood for trapping and carrying the dirty gases rising from glowing coke on the quenching car;

coupling means between said hood car and said quenching car that is operable when said quenching car is moving in said forward and backward directions for coupling together said hood car and said quenching car and for permitting movement of said hood car and said quenching car together in said forward and backward directions, said coupling means defining a coupling opening in said hood car; said coupling means also including (a) a driver element on said quenching car, (b) a hydraulic coupling control system, and (c) a driver element cylinder-piston actuator operable with a pressurized medium by said hydraulic coupling control system for moving said driver element transversly of the forward and backward directions of travel of said quenching car and said hood car into and out of said coupling opening in said hood car whereby said driver element may be engaged with, or disengaged from, said hood car; said coupling means further including a pair of spaced-apart parallel stop bars defining at least part of said coupling opening, said stop bars being oriented transversely of the directions of forward and backward travel of said hood car and quenching car, said stop bars being adapted to be horizontally displaced toward and away from each other in substantially parallel relationship; said coupling means additionally including compression coupling springs urging said stop bars towards each other, said stop bars having mutually facing sides which at least partially define diverging surfaces to accommodate entry of said driver element between said stop bars;

brake means on said hood car for automatically stopping the hood car movement when the hood car is uncoupled from the quenching car but for being released to permit movement of the hood car when the quenching car is coupled to the hood car, said brake means comprising (a) a stationary brake rail, (b) a pair of pivotally mounted brake jaws adapted to grip said brake rail, (c) brake compression springs urging said brake jaws to pivot toward each other and against said brake rail, (d) a hydraulic brake release cylinder-piston actuator connected to pivot said brake jaws away from each other, (e) a hydraulic brake control cylinder-piston actuator for activating said brake release cylinder-piston actuator and having an associated control piston rod adapted to be engaged by said driver element of said quenching car, and (f) a hydraulic brake control system for operating said brake release cylinder-piston actuator from said hydraulic brake control cylinder-piston actuator; the cylinder portion of said hydraulic brake release cylinder-piston actuator being connected to one of said brake jaws; said hydraulic brake release cylinder-piston actuator having an associated piston rod pivotally connected to the other of said brake jaws such that when said brake release cylinder-piston actuator is activated, the brake jaws are pivoted away from each other against the action of the brake compression springs and away from stationary brake rail; and an emergency brake control consisting of a switching control means on said quenching car connected via the pressure medium through said hydraulic coupling control system to said driver element cylinder-piston actuator, said switching control means adapted to be activated by a stationary switching cam mounted at a selected position along the path of travel of said quenching car to operate said driver element cylinder-piston actuator to retract said driver element out of said hood car coupling opening.

2. The equipment in accordance with claim 1 in which said driver element includes a driver lug pivotally mounted at one end to the piston of said driver element cylinder-piston actuator, said driver lug being pivotally mounted about an axis generally parallel to said stop bars for pivotal movement in said forward and backward directions of travel of said quenching car and said hood car.

3. The equipment in accordance with claim 2 in which said driver lug includes walls that slant toward each other to define a pyramidal frustrum at one end of said driver lug.

* * * * *